US008794161B2

(12) United States Patent
Lu et al.

(10) Patent No.: US 8,794,161 B2
(45) Date of Patent: Aug. 5, 2014

(54) LIFTING AND ROTATING DEVICE

(71) Applicant: Syncmold Enterprise Corp., New Taipei (TW)

(72) Inventors: Der-Wei Lu, New Taipei (TW); Chung-Cheng Hu, New Taipei (TW); Ren-Yu Liou, New Taipei (TW)

(73) Assignee: Syncmold Enterprise Corp., New Taipei (TW)

( * ) Notice: Subject to any disclaimer, the term of this patent is extended or adjusted under 35 U.S.C. 154(b) by 0 days.

(21) Appl. No.: 13/893,477

(22) Filed: May 14, 2013

(65) Prior Publication Data

US 2014/0182488 A1 Jul. 3, 2014

(30) Foreign Application Priority Data

Dec. 27, 2012 (TW) ..... 101225248 U
Apr. 9, 2013 (TW) ..... 102206364 U

(51) Int. Cl.
*A47B 27/00* (2006.01)
*A47B 27/16* (2006.01)

(52) U.S. Cl.
CPC ..... *A47B 27/16* (2013.01)
USPC ..... 108/6; 108/147

(58) Field of Classification Search
USPC ..... 108/6–8, 115, 147, 150, 2, 146, 136; 297/344.19, 313, 327; 248/371, 372.1, 248/398, 631
See application file for complete search history.

(56) References Cited

U.S. PATENT DOCUMENTS 3,711,054 A * 1/1973 Bauer ..... 248/562
3,756,654 A * 9/1973 Bauer ..... 297/344.19
4,328,943 A * 5/1982 Eldon, III ..... 248/578
4,373,692 A * 2/1983 Knoblauch et al. ..... 248/162.1
4,938,531 A * 7/1990 Fogarassy ..... 297/300.4
5,029,940 A * 7/1991 Golynsky et al. ..... 297/300.4
5,102,196 A * 4/1992 Kaneda et al. ..... 297/452.15
5,121,697 A * 6/1992 Baum et al. ..... 108/124
5,244,253 A * 9/1993 Hollington et al. ..... 297/344.19
5,427,434 A * 6/1995 Hybarger ..... 297/301.4
5,797,653 A * 8/1998 Elzenbeck et al. ..... 297/300.5
5,810,439 A * 9/1998 Roslund, Jr. ..... 297/300.4
5,873,628 A * 2/1999 Allard et al. ..... 297/326
6,030,037 A * 2/2000 Ritch et al. ..... 297/239
6,139,103 A * 10/2000 Hybarger et al. ..... 297/300.5
6,213,552 B1 * 4/2001 Miotto ..... 297/300.5
6,361,110 B2 * 3/2002 Roslund et al. ..... 297/344.19
6,425,633 B1 * 7/2002 Wilkerson et al. ..... 297/300.2
6,739,666 B2 * 5/2004 Alampi ..... 297/337
7,721,399 B2 * 5/2010 Tedesco ..... 29/402.08
2004/0065238 A1 * 4/2004 Chen ..... 108/147
2012/0227642 A1 * 9/2012 Sekikawa ..... 108/147

* cited by examiner

*Primary Examiner* — Janet M Wilkens
(74) *Attorney, Agent, or Firm* — Steptoe & Johnson LLP

(57) ABSTRACT

A lifting and rotating device includes a lifting unit having a gas lift and a support member having a hinge; a rotating unit rotatable around the hinge; and a decompression unit having a handle movable between a release position and a control position, a pressure regulating member pivotally disposed on the hinge and normally located at a release position, and a cable having one end connected to the handle and the other end connected to the pressure regulating member at a position substantially located on the pivot axis of the hinge. The handle is normally at the release position and the relative position between the pressure regulating member and a control pin of the gas lift remains unchanged when the rotating unit rotates around the hinge. When the handle is moved to the control position by an external force, the pressure regulating member is moved to press the control pin.

14 Claims, 11 Drawing Sheets

LIFTING AND ROTATING DEVICE

BACKGROUND OF THE INVENTION

1. Field of the Invention

The present invention relates to adjustable office furniture, and more particularly, to a lifting and rotating device applicable to office furniture.

2. Description of Related Art

FIGS. 1A and 1B are schematic views showing conventional desks having lifting and tilting structures. Referring to FIG. 1A, a tilting structure 80 is provided for tilting a reading plate 81 of the desk, and a gas lift 83 is provided for raising or lowering a top plate 82 of the desk. Referring to FIG. 1B, a gas lift 93 is provided for tilting a reading plate 91 and a telescoping tube set 90 is configured for raising or lowering a top plate 92. However, in the above-described desks, the lifting mechanism and the tilting mechanism are separate from one another. Therefore, the size and cost of the desks are increased, and the tilting angle is limited within a certain range, such as below 45 degrees, so as to limit the use of the desks, especially for touch screens.

Accordingly, there is a need to provide a lifting and rotating device so as to overcome the above-described drawbacks.

SUMMARY OF THE INVENTION

In view of the above-described drawbacks, the present invention provides a lifting and rotating device with lifting and tilting functions that do not affect one another.

Accordingly, the present invention provides a lifting and rotating device applicable to office furniture with a base. The lifting and rotating device comprises a lifting unit, a rotating unit and a decompression unit. The lifting unit comprises a gas lift configured to be disposed on a base of the office furniture and having a telescopic rod and a control pin disposed at one end of the telescopic rod for controlling movement of the telescopic rod; and a support member disposed on the end of the telescopic rod adjacent to the control pin and capable of moving up and down along with the movement of the telescopic rod, wherein the support member has at least a hinge for defining a pivot axis. The rotating unit comprises a main body pivotally disposed on the hinge and rotatable around the pivot axis. Through the rotating unit, a work plate of the office furniture can tilt between 0 and 90 degrees. The decompression unit comprises a handle movable between a release position and a control position; a pressure regulating member pivotally disposed on the hinge and normally located at a release position; and a cable having one end connected to the handle and the other end connected to the pressure regulating member at a position that is substantially located on the pivot axis. As such, the handle is normally located at the release position, and the relative position between the pressure regulating member and the control pin remains unchanged when the rotating unit rotates around the pivot axis. On the other hand, when the handle is moved to the control position by an external force, the pressure regulating member is moved to press the control pin.

In an embodiment, the rotating unit further comprises a steering member disposed on a surface of the main body close to the pressure regulating member and away from the support member so as to change the traction direction of the cable.

In an embodiment, the rotating unit further comprises a tray member fixed to one side of the main body away from the hinge and the work plate of the office furniture is disposed on the tray member.

In an embodiment, the main body of the rotating unit comprises a first plate connected to the tray member and two second plates vertically disposed at two ends of the first plate such that the first and second plates form an inverted U-shaped structure, wherein the hinge passes through the second plates so as to cause the rotating unit to rotate around the pivot axis and move between a first position and a second position.

The steering member can be a pulley group that comprises a first fixed pulley and a second fixed pulley. The traction direction of the cable is changed through the first and second fixed pulleys and the rotating unit is located at the first position or the second position, and the cable is connected to the pressure regulating member through the first fixed pulley at a position that is located on the pivot axis.

The hinge can have a second torsion spring disposed therearound. The second torsion spring has a first end fixed to a connection port of the support member and a second end abutting against an abutting portion of the first plate.

The office furniture includes a work plate, and the work plate is disposed on the handle. The handle can be disposed on a fixed shaft that is fixed to the tray member through a fixing portion and has a first torsion spring disposed therearound. As such, the handle is moved around the fixed shaft so as to pull the cable extending along the pivot axis, thereby causing the pressure regulating member to move. Therein, when the handle is at the control position, the first torsion spring is compressed to generate a restoring force to move the handle back to the release position.

In an embodiment, the control pin comprises a gas pressure head disposed on the end of the telescopic rod close to the support member and comprises a valve control member. When the pressure regulating member is at the release position, the pressure regulating member abuts against the gas pressure head without pressing down the gas pressure head. When being pulled by the cable, the pressure regulating member presses down the gas pressure head to cause the valve control member to regulate the internal pressure of the gas lift. The gas lift can further comprise an abutting member disposed around the gas pressure head for abutting against the pressure regulating member.

In an embodiment, the pressure regulating member is disposed on the connection port and comprises a connecting portion for connecting with the cable and an abutting portion for abutting against the gas lift.

In another embodiment, the pressure regulating member comprises a sliding block, a sliding track and a spring. When the cable is pulled, the sliding block slides along the sliding track connected to the connection port and returns to the release position through the telescopic spring.

The device can further comprise a third fixed pulley disposed between the tray member and the main body of the rotating unit and a fourth fixed pulley disposed close to the handle. As such, the traction direction of the cable is changed through the third and fourth fixed pulleys.

The device can further comprise a locking unit, which comprises: an outer positioning portion disposed on the hinge; a locking rod having a screwing structure and passing through the support member, the rotating unit and the outer positioning portion, one end of the locking rod having a washer attached to the outer positioning portion and the other end being exposed from the support member; and a locking member disposed around the other end of the locking rod exposed from the support member, wherein by moving the locking rod to lock the screwing structure and the washer, the distance between the locking member and the washer is adjusted. The locking unit can further comprise two iron plates disposed between the support member and the rotating unit and between the rotating unit and the outer positioning portion, respectively, so as to increase the friction effect.

Therefore, the lifting and rotating device of the present invention connects the cable and the pressure regulating member at a position substantially located on the pivot axis of the hinge such that even if the rotating unit rotates an angle relative to the support member, the telescopic rod can be moved through the handle. As such, the tilting mechanism and the lifting mechanism are combined to reduce the overall size of the device and simplify the structure of the device. Furthermore, the lifting and tilting mechanisms do not affect one another, thus facilitating the practical operation.

DETAILED DESCRIPTION OF PREFERRED EMBODIMENTS

The following illustrative embodiments are provided to illustrate the disclosure of the present invention, these and other advantages and effects can be apparent to those in the art after reading this specification.

It should be noted that all the drawings are only for illustrative purpose and not intended to limit the present invention. Various modification and variations can be made without departing from the spirit of the present invention.

Figure 1A:
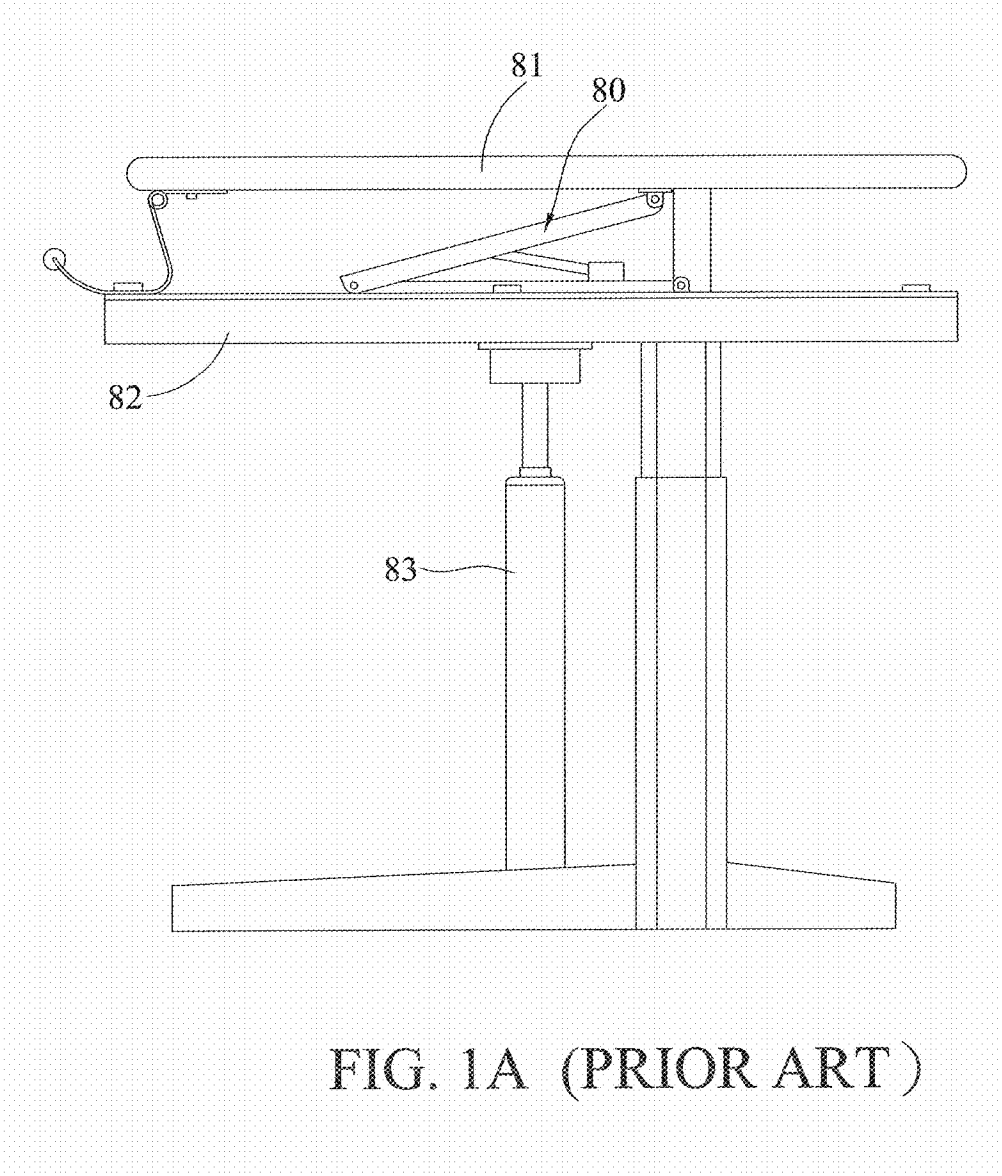
FIG. 1A (PRIOR ART)
FIGS. 1A and 1B are schematic views of conventional desks having lifting and tilting structures.
Figure 1B:
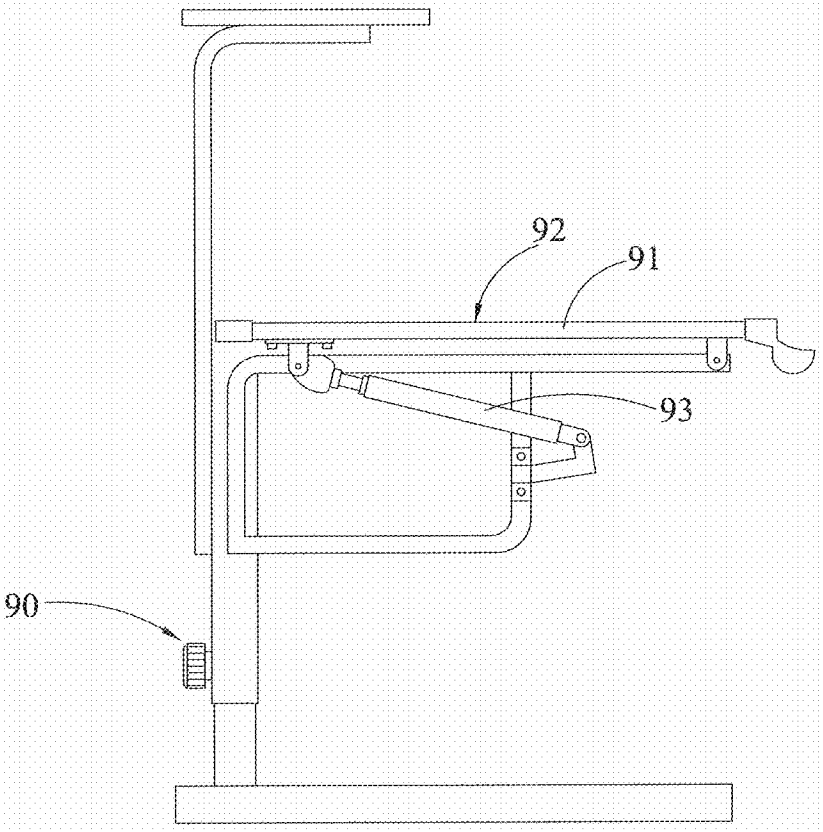
FIG. 1B (PRIOR ART)
Figure 2:
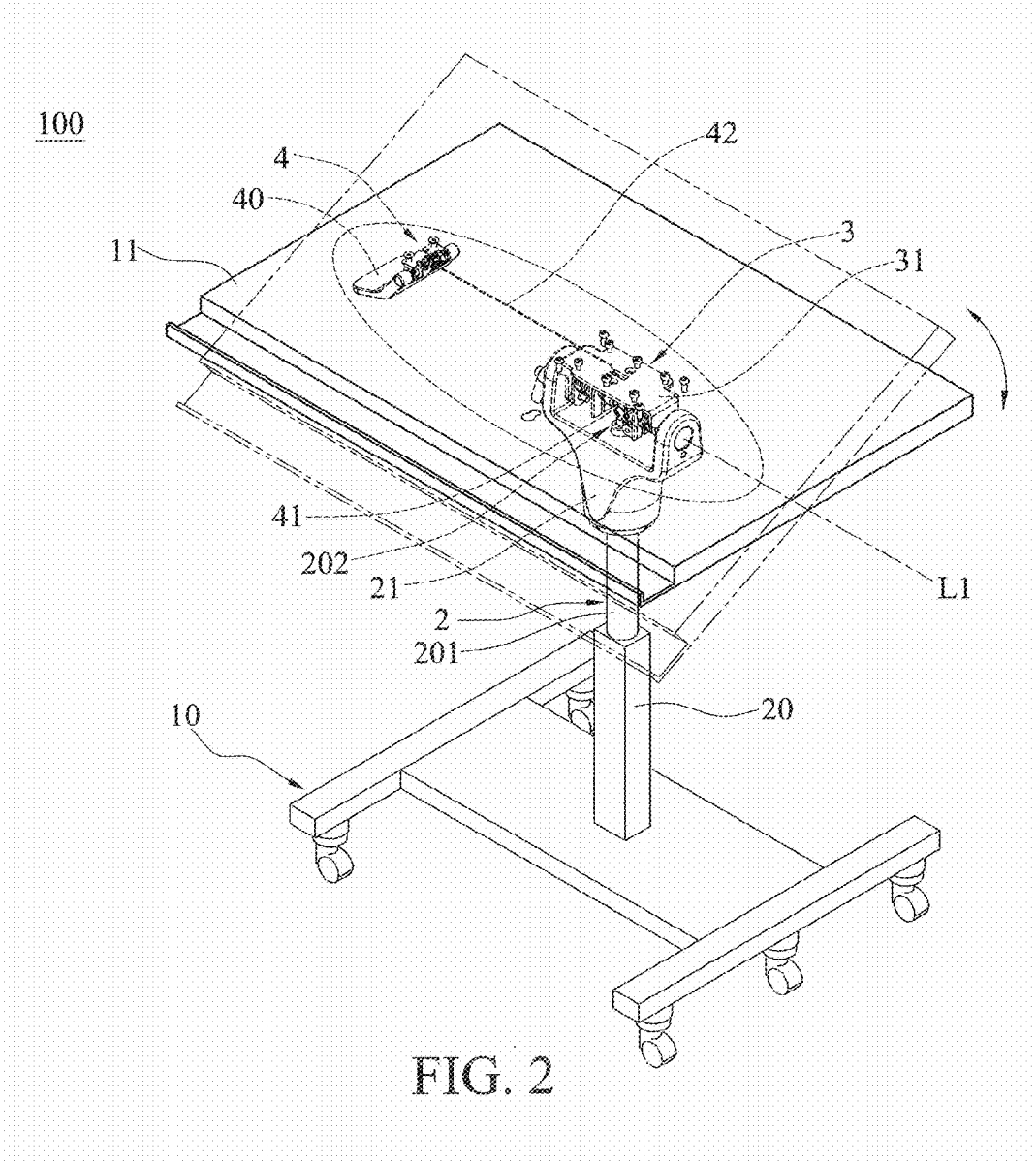
FIG. 2 is a schematic view of a lifting and rotating device of the present invention.

A lifting and rotating device applicable to office furniture, such as a whiteboard or a drawing board, is provided. FIG. 2 is a schematic view showing a lifting and rotating device of the present invention. Referring to FIG. 2, the lifting and rotating device 100 is applicable to a drawing board. The lifting and rotating device 100 has a lifting unit 2, a rotating unit 3 and a decompression unit 4. The lifting unit 2 is connected to a base 10 of the drawing board placed on the ground (not shown). The work plate 11 is disposed on the rotating unit 3. The work plate 11 can rotate an angle of 90 degrees through the rotating unit 3. That is, the work plate 11 can be perpendicular to the ground. The decompression unit 4 can control raising or lowering the work plate 11.

In particular, the lifting unit 2 has a gas lift 20 and a support member 21. The gas lift 20 is connected to the base 10 through a lower portion thereof. The gas lift 20 has a telescopic rod 201 and a control pin 202 disposed at one end of the telescopic rod 201 for controlling movement of the telescopic rod 201. The support member 21 is disposed at the end of the telescopic rod 201 of the gas lift 20 adjacent o the control pin 202. The support member 21 can move up and down along with the movement of the telescopic rod 201 of the gas lift 20. Further, the support member 21 has two hinges 213 (referring to FIG. 3A) aligning at a pivot axis L1.

The rotating unit 3 has a main body 31 pivotally disposed on the hinges 213 and rotatable around the pivot axis L1. Through rotating of the main body 31, the work plate 11 can be parallel or perpendicular to the upper surface of support member 21 (namely, the ground), i.e., tilting an angle of 0 degree or 90 degrees relative to the support member 21.

The decompression unit 4 has a handle 40, a pressure regulating member 41 and a cable 42. The handle 40 is movable between a release position and a control position. The pressure regulating member 41 is pivotally disposed on the hinges 213 of the support member 21. In this embodiment, the pressure regulating member 41 rotates around a pivot axis substantially perpendicular to the pivot axis L1. The pressure regulating member 41 is normally located at a release position, i.e., the control pin 202 is not pressed by the pressure regulating member 41. The cable 42 has one end connected to the handle 40 and the other end connected to the pressure regulating member 41 at a position that is substantially located on the pivot axis L1 defined by the hinges 213.

Therefore, the handle 40 is normally located at the release position, and when the rotating unit 3 rotates around the pivot axis L1, the relative position between the pressure regulating member 41 and the control pin 202 remains unchanged. On the other hand, when the handle 40 is moved to the control position by an external force, the pressure regulating member 41 is moved to press the control pin 202. In other words, no matter whether the work plate 11 is parallel or perpendicular to the support member 21, the telescopic rod 201 of the gas lift 20 can be moved through the handle 40. That is, the position of the pressure regulating member 41 is not affected by rotation of the rotating unit 3.

Figure 3A:
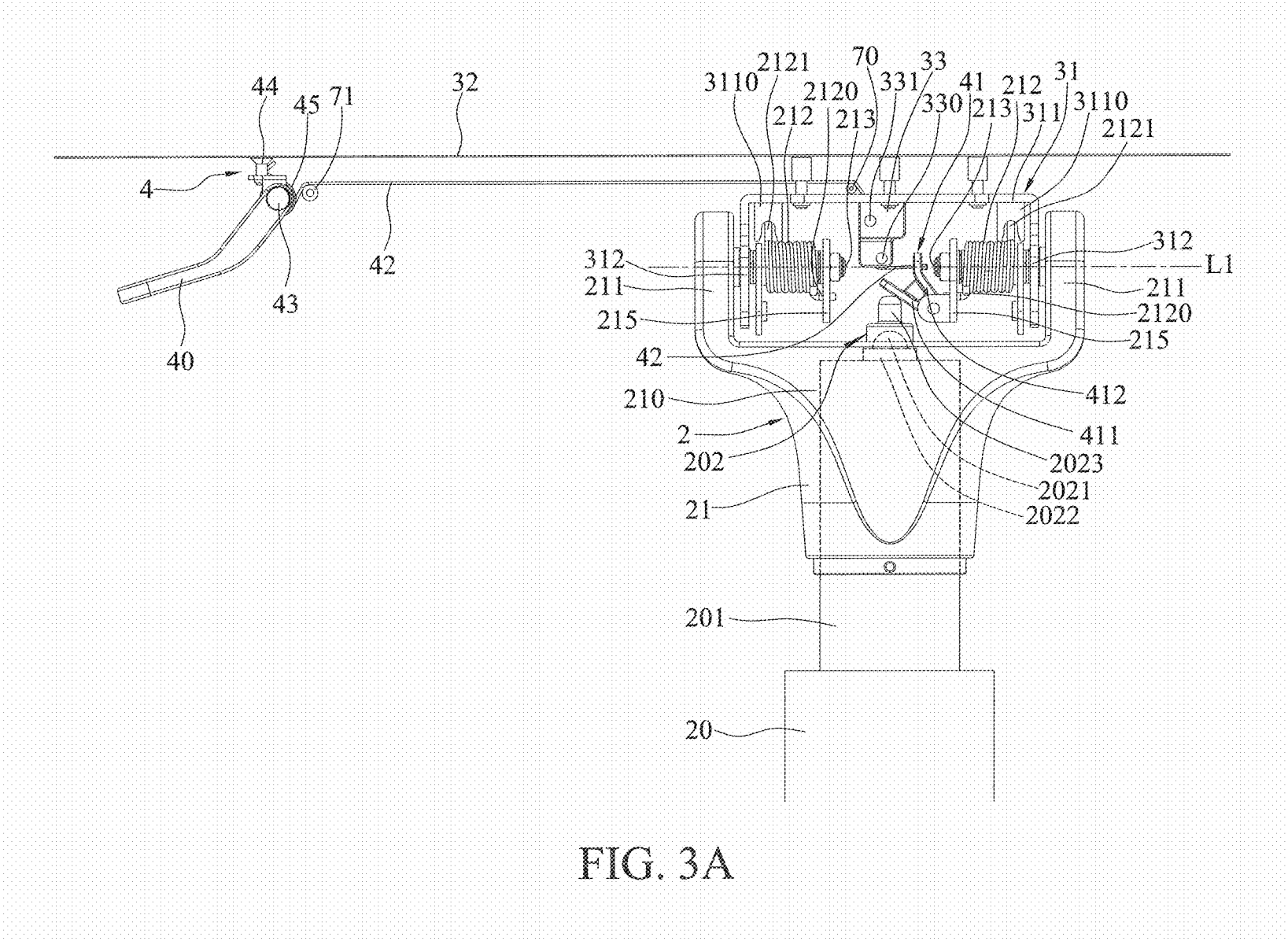
FIGS. 3A and 3B are schematic views showing the lifting and rotating device under a normal state and a decompression state according to the present invention.
Figure 3B:
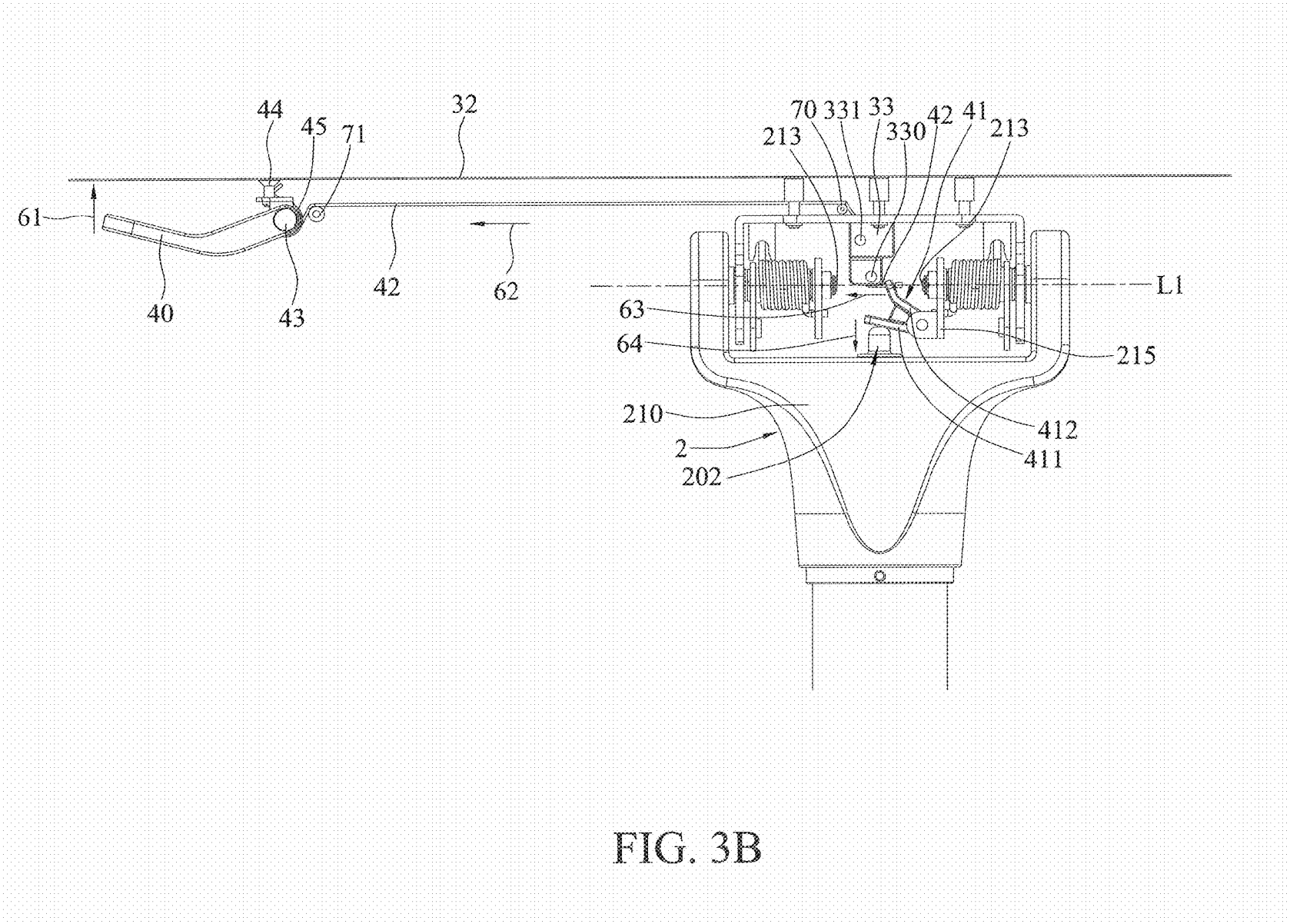

FIGS. 3A and 3B are schematic views of the lifting and rotating device under a normal state and a decompression state. Referring to FIG. 3A, by adjusting gas pressure, the telescopic rod 201 is extended or retracted so as to raise or lower the support member 21.

The support member 21 has a main portion 210 and two side portions 211 vertically extending from two sides of the main portion 210 such that the main portion 210 and the two side portions 211 form a U-shaped structure. The hinges 213 are configured between the two side portions 211. In the present embodiment, the pivot axis L1 passes through the axis of the hinges 213 and is substantially parallel to an upper surface of the main portion 210 (namely, the ground). The hinges 213 have a connection port 215 disposed close to the control pin 202 for connecting the pressure regulating member 41. In an alternative embodiment, only one hinge 213 is provided with the pivot axis L1 still passing through the axis of the hinge 213.

The main body 31 of the rotating unit 3 is pivotally disposed on the two hinges 213 and between the two side portions 211 of the support member 21. The rotating unit 3 further has a tray member 32 fixed to one side of the main body 31 away from the hinges 213. The work plate 11 is fixed to one side of the tray 32 away from the main body 31. Further, the main body 31 has a first plate 311 and two second plates 312 vertically extending from two ends of the first plate 311 such that the first plate 311 and the second plates 312 form an inverted U-shaped structure. The two hinges 213 penetrate through the second plates 312, respectively, so as to allow the rotating unit 3 to rotate around the pivot axis L1, thus causing the tray member 32 to change between a first position and a second position. That is, the work plate 11 is changed between a horizontal position and a vertical position. In other words, the angle between the tray member 32 and the upper surface of the support member 21 is maximum (90 degrees) at the first position and minimum (0 degree) at the second position. The tray member 32 can be fixed to the first plate 311 through a plurality of screws (not numbered).

Figure 6A:
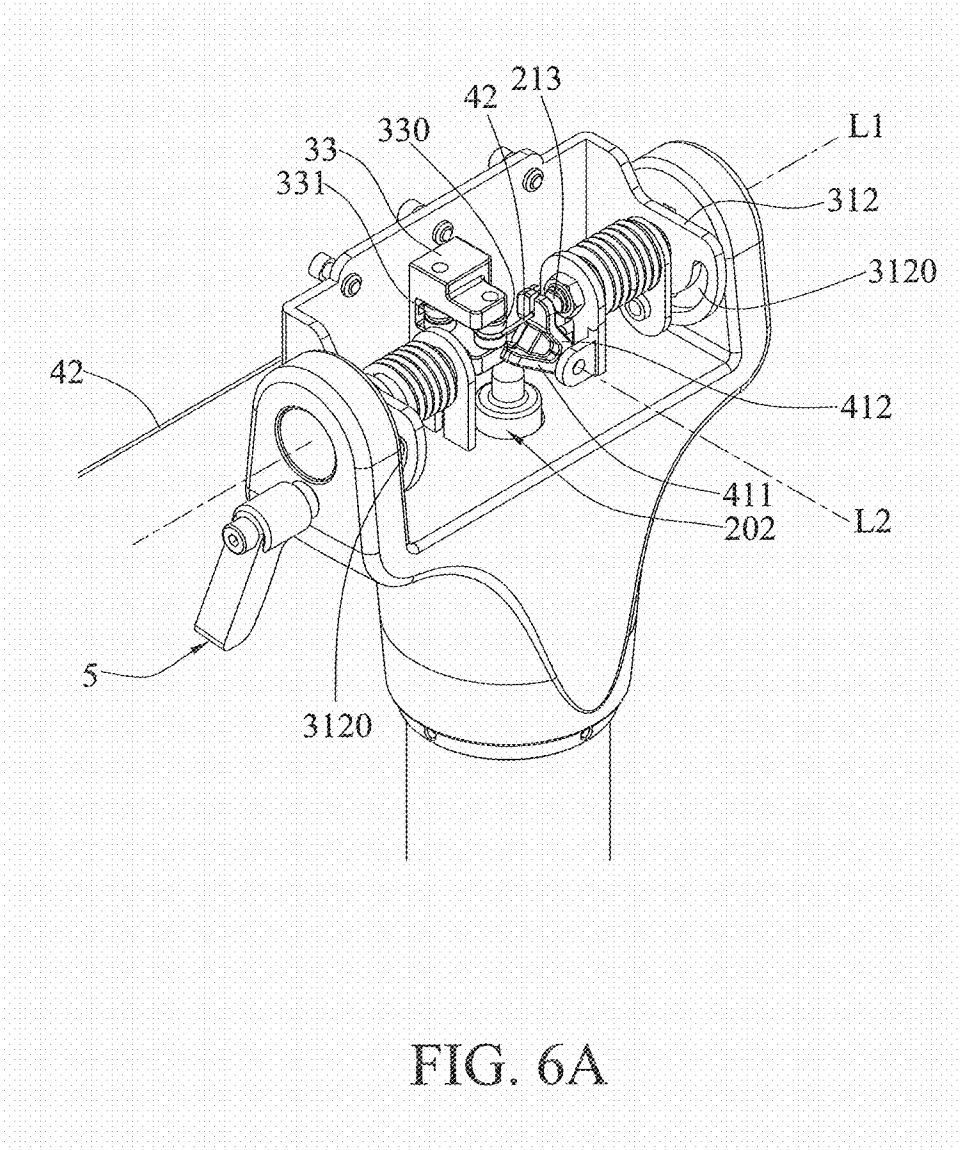
FIGS. 6A and 6B are side and top views of the lifting and rotating device after rotating an angle of 90 degrees according to the present invention.

The handle 40 of the decompression unit 4 is movable between the release position and the control position. More specifically, if no external force is applied, the handle 40 tends to remain at the release position. On the other hand, an external force is needed to switch the handle 40 to the control position. The pressure regulating member 41 is pivotally disposed on the connection port 215 so as to define a pivot axis L2 (as shown in FIG. 6A) perpendicular to the pivot axis L1. That is, the pressure regulating member 41 can rotate around the pivot axis L2. The pressure regulating member 41 is of a substantially V-shape and has an abutting portion 411 and a connecting portion 412. The abutting portion 411 normally abuts against the control pin 202 of the gas lift 20. The cable 42 has one end connected to the handle 40 and the other end connected to the pressure regulating member 41. A portion of the cable 42 connected to the pressure regulating member 41 is located on the rotating axis L1.

The control pin 202 of the gas lift 20 has an abutting protrusion 2023, a gas pressure head 2021 and a valve control member 2022. The abutting protrusion 2023 passes through the main portion 210 of the support member 21 and disposed on the gas pressure head 2021. The valve control member 2022 is disposed on the end of the telescopic rod 201 close to the support member 21. At the release position (or the normal state), the pressure regulating member 41 abuts against the abutting protrusion 2023 without pressing down the gas pressure head 2021. On the other hand, when being pulled by the cable 42, the pressure regulating member 41 presses down the abutting protrusion 2023 and the gas pressure head 2021 so as for the valve control member 2022 to adjust the inner pressure of the gas lift 20, and thus the telescopic rod 201 can be adjusted for extension or retraction so as to raise or lower the support member 21. In another embodiment, the abutting protrusion 2023 can be omitted such that the pressure regulating member 41 directly abuts against the gas pressure head 2021.

In an embodiment, the hinges 213 have a pair of second torsion springs 212, respectively. Each of the second torsion springs 212 has a first end 2120 fixed to the connection port 215 of the support member 21 and a second end 2121 abutting against an abutting member 3110 of the first plate 311. When the main body 31 of the rotating unit 3 rotates to the first position and the tray member 32 is perpendicular to the horizontal plane, the second torsion springs 212 are compressed to provide a reverse restoring force. As such, the second torsion springs 212 in combination with those washers of hinges 213 balance the weight of the tray member 32, the work plate 11 and a display (not shown) on the work plate 11 and consequently the tray member 32 and the work plate 11 can stop at any position. Since such a technique is well known in the art, detailed description thereof is omitted herein.

Figure 4:
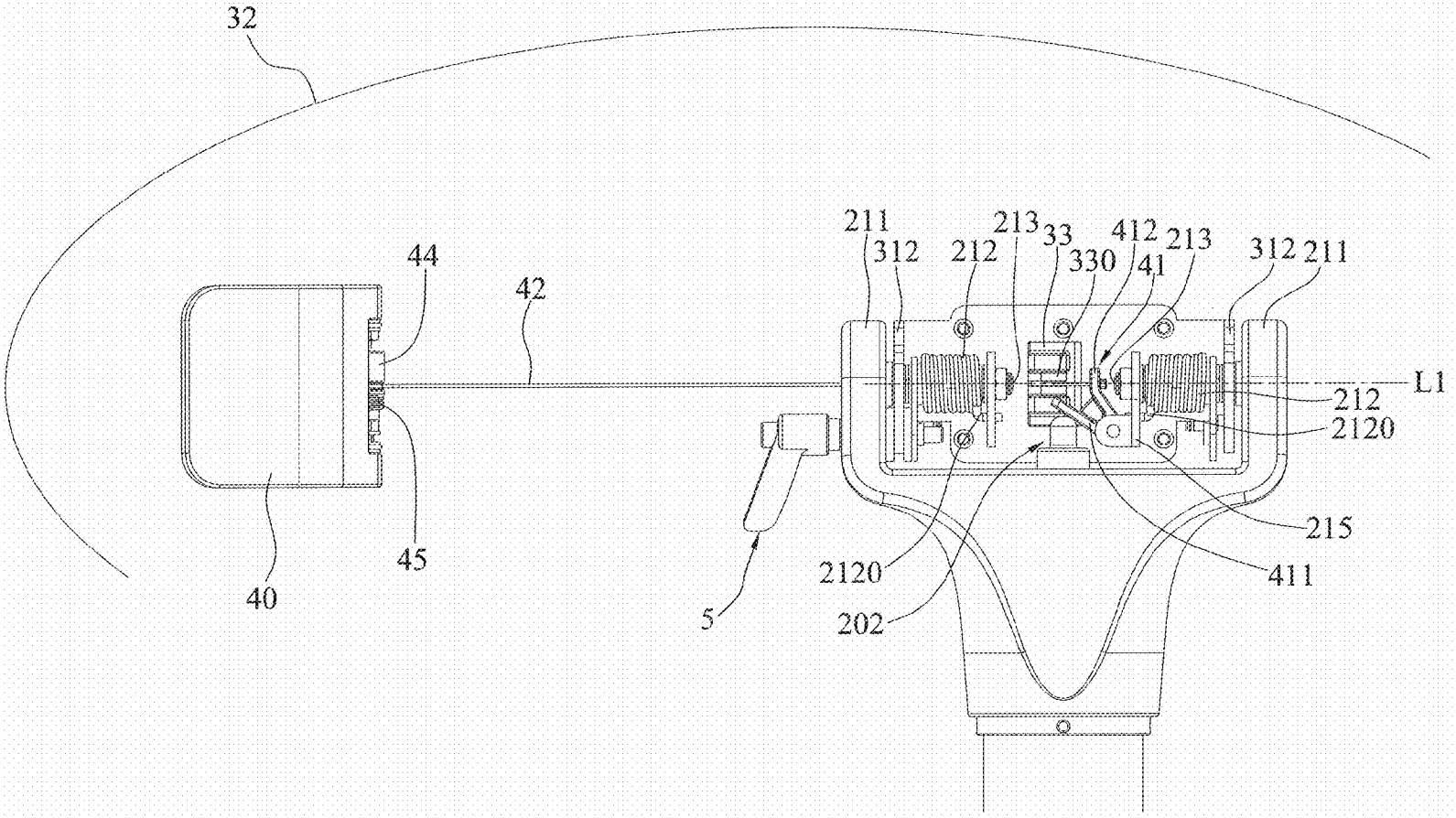
FIG. 4 is a schematic view of the lifting and rotating device with a rotating unit rotating an angle of 90 degrees according to the present invention.

Referring to FIGS. 2, 3A and 4, to facilitate operation, the handle 40 is disposed on the tray member 32 and away from the support member 21. As such, the traction direction at the position where the cable 42 is connected to the handle 40 does not coincide with the pivot axis L1. Therefore, when the tray 32 tilts, it might result in an inappropriate traction of the cable 42, resulting in the pressure regulating member 41 undesirably pressing down the abutting protrusion 2023. In order to avoid that the above situation, the main body 31 of the rotating unit 3 further has a steering member 33 disposed on a surface of the first plate 311 close to the pressure regulating member 41 and between the second plates 312 so as to change the traction direction of the cable 42. In this embodiment, the steering member 33 is a pulley group that has a first fixed pulley 330 and a second fixed pulley 331 for ensuring that a portion of the cable 42 connected between the first fixed pulley 330 and the pressure regulating member 41 coincides with the pivot axis L1, no matter whether the rotating unit is at the first position or the second position. In other words, the cable 42 is at least partly extended along the pivot axis L1 and fixed to the connecting portion 412 of the pressure regulating member 41. Besides, the steering member 33 can keep the cable 42 in a tension state so as to facilitate operation.

On the other hand, if the entire cable 42 is disposed along the pivot axis L1 and passes through the support member 21, the steering member 33 can be omitted.

Figure 7:
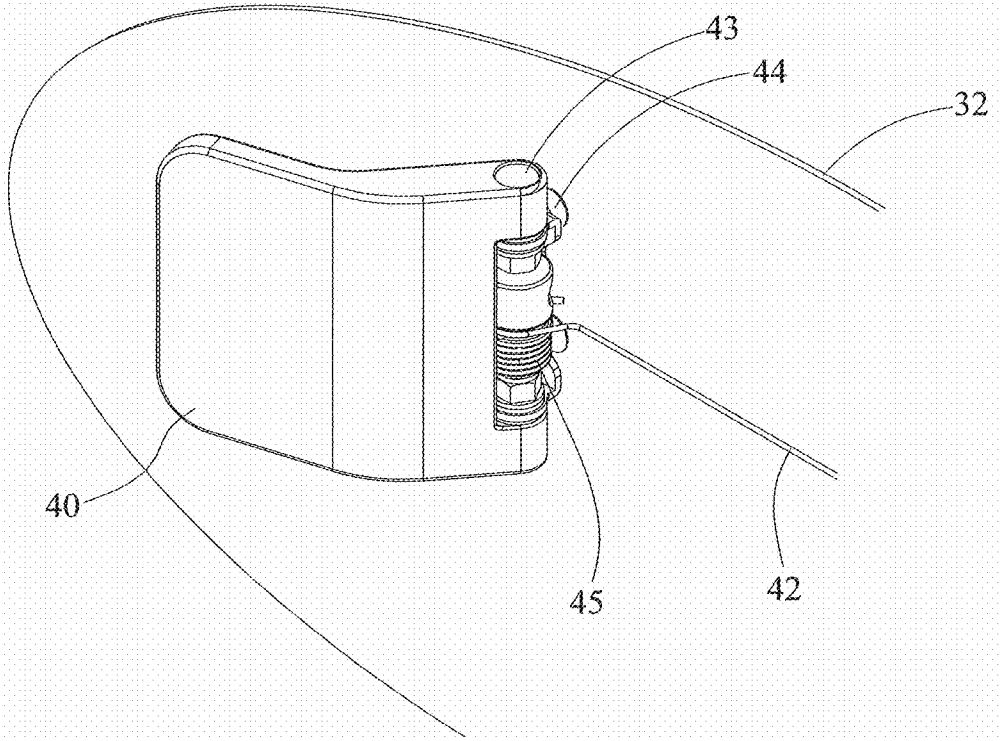
FIG. 7 is a schematic view of a handle of the lifting and rotating device of the present invention.

FIG. 7 is a schematic view of the handle of the lifting and rotating device. Referring to FIG. 7, the handle 40 is disposed on a fixed shaft 43 fixed to the tray member 32 through a fixing portion 44. A first torsion spring 45 sleeves on the fixed shaft 43. The first torsion spring 45 abuts against the handle 40 with one end and against the fixing portion 44 with the other end. The handle 40 can rotate around the fixed shaft 43 so as to pull the pressure regulating member 41 through the cable 42. When the handle 40 is moved to the control position by an external force, the first torsion spring 45 is biased and generates a restoring force. After the external force is removed, the restoring force generated by the first torsion spring 45 causes the handle 40 to move back to the release position. In practice, referring to FIG. 3B, the handle 40 is moved up in a direction 61 towards the tray member 32 so as to wind the cable 42 clockwise around the fixed shaft 43. At the same time, the cable 42 between the fixed shaft 43 and the second fixed pulley 331 is moved in a traction direction 62 and the cable 42 between the first fixed pulley 330 and the connecting portion 412 is moved in a traction direction 63 along the pivot axis L1, thereby bringing the abutting portion 411 of the pressure regulating member 41 to rotate around the pivot axis L2 (as shown in FIG. 6A) to thereby press down the control pin 202 of the gas lift 20 in a direction 64. When the handle 40 is moved, the first torsion spring 45 is compressed to generate a restoring force. After the handle 40 is released, the restoring force will cause the handle 40 to move back to the release state. That is, the handle 40 is moved in a direction opposite to the direction 61. As such, the cable 42 is moved in a direction opposite to the direction 62 so as to bring the connecting portion 412 to move in a direction opposite to the direction 63, thus causing the abutting portion 411 to move in a direction opposite to the direction 64 so as not to press down the control pin 202 of the gas lift 20.

Figure 6B:
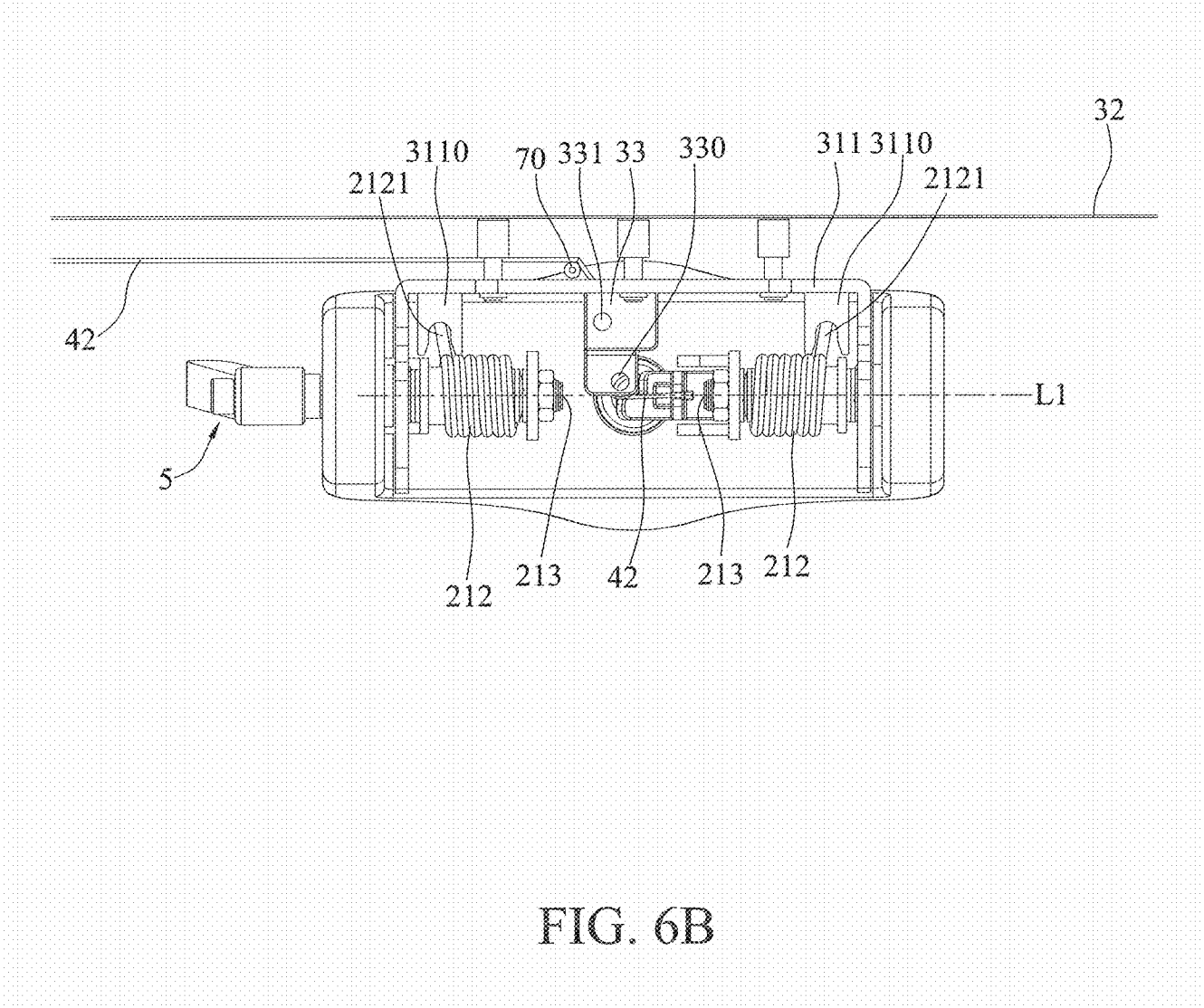

FIG. 4 shows the lifting and rotating device with the rotating unit rotating an angle of 90 degrees, i.e., the rotating unit 3 being at the first position. FIGS. 6A and 6B show side and top views of the structure of FIG. 4.

Referring to FIGS. 4, 6A and 6B, the first ends 2120 of the second torsion springs 212 are fixed to the connection ports 215 of the support member 21. For example, the connection ports 215 has openings for the first ends 2120 to pass through, thereby fixing the first ends 2120 to the connection ports 215. The second ends 2121 of the second torsion springs 212 abut against the abutting member 3110 of the first plate 311 so as for the second torsion springs 212 to generate a bias. As such, the second torsion springs 212 in combination with the washers (not numbered) allow the tray member and the work plate to stop at any position.

The rotating unit 3 can rotate between the first position and the second position. No matter whether the rotating unit 3 is at the first position or the second position, the part of cable 42 between the first fixed pulley 330 and the connecting portion 412 coincides with the pivot axis L1. It means that the part of cable 42 between the first fixed pulley 330 and 331 keeps its relative position during the rotation of the rotating unit 3, and thus an unexpected traction will not be induced. Therefore, the movement of the pressure regulating member 41 caused by the handle 40 through the cable 42 is not affected by rotating of the rotating unit 3. Upon the rotation, the rotating unit 3 may be fixed with a locking unit 5, for example.

Figure 5:
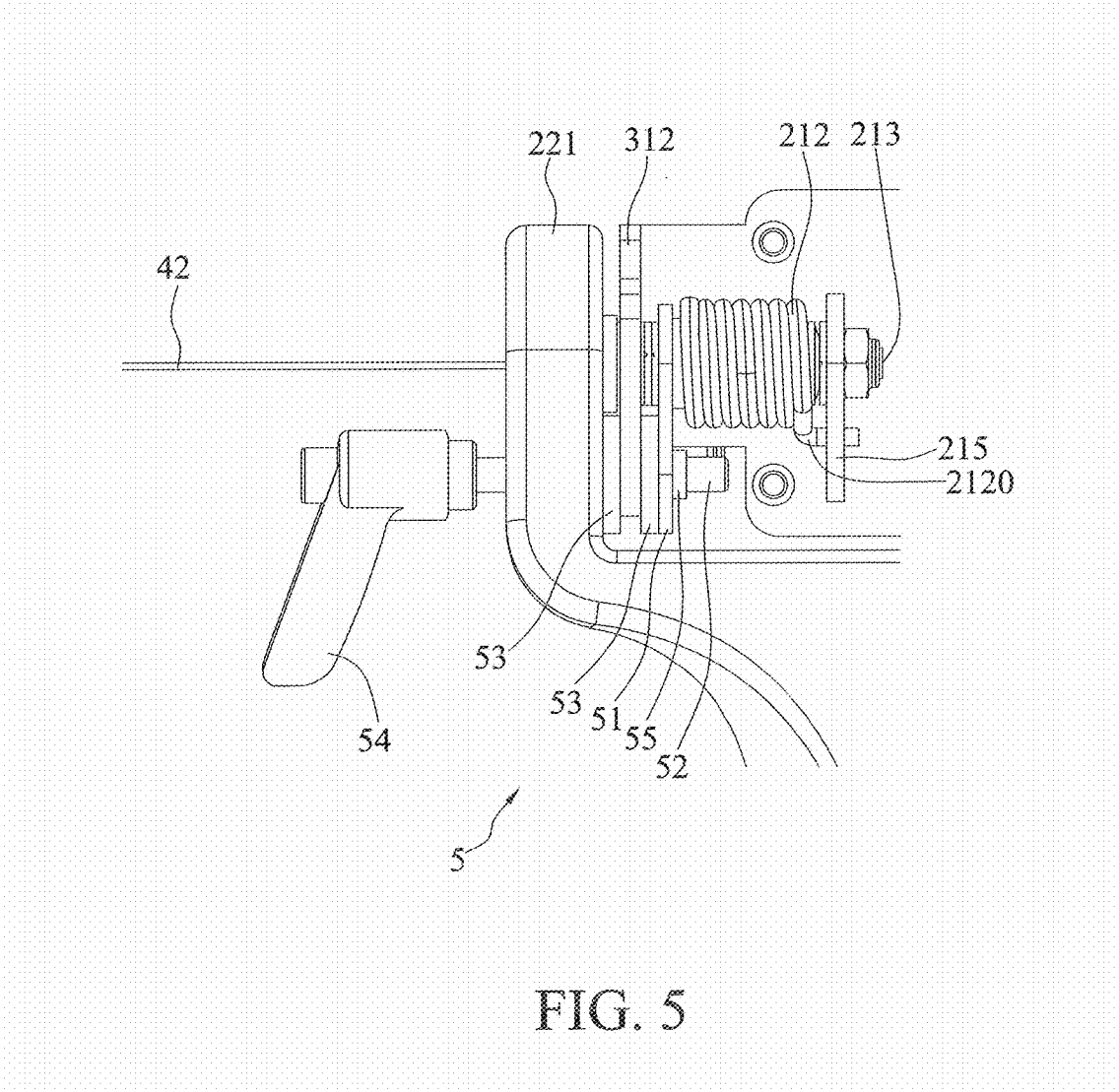
FIG. 5 is a schematic view of a locking unit of the lifting and rotating device of the present invention.

FIG. 5 shows a locking unit of the lifting and rotating device for locking and fixing the rotating unit 3 after rotation. The locking unit 5 has an outer positioning portion 51, a locking rod 52 and a locking member 54. The outer positioning portion 51 is disposed on the hinge 213. The locking rod 52 has a screwing structure (not shown). The locking rod 52 passes through the side portion 211, the second plate 312 of the rotating unit 3 and the outer positioning portion 51. A washer 55 is disposed at one end of the locking rod 52 and attached to the outer positioning portion 51. The other end of the locking rod 52 is exposed from the side portion 211. The locking member 54 is disposed on the exposed end of the locking rod 52 so as for the user to operate the locking rod 52. To achieve a locking effect, the locking rod 52 is moved towards the side portion 211, and the screwing structure of the locking rod 52 engages with the washer 55 to reduce the distance between the locking member 54 and the washer 55. Therefore, the second plate 312 of the rotating unit 3 is fixed. Referring to FIG. 6A, the locking rod 52 passes through a groove 3120 on the second plate 312. Therefore, when the rotating unit 3 rotates between the first position and the second position, the position of the locking rod 52 in the groove 3120 is changed. By reducing the distance between the locking member 54 and the washer 55, the friction between the side portion 211, the second plate 312 and the outer positioning portion 41 is increased to thereby fix the rotating unit 3 at any position of the groove 3120. To strengthen the locking effect, two iron plates 53 can be disposed around the locking rod 52 and respectively between the side portion 211 and the second plate 312 and between the second plate 312 and the outer positioning portion 51, thereby increasing the friction effect and filling the gap therebetween to avoid deformation of the rotating unit 3 or the outer positioning portion 51. The groove 3120 of the present embodiment is a quarter arc of a circle so as to allow the tray member 32 to be parallel or perpendicular to the ground.

Referring to FIGS. 3A, 3B and 4, the lifting and rotating device 100 further has a third fixed pulley 70 disposed between the tray member 32 and the main body 31 of the rotating unit 3 and a fourth fixed pulley 71 disposed on the fixing portion 44 of the handle 40. Therefore, the cable 42 is connected to the handle 40 through the fourth fixed pulley 71 such that the traction direction of the cable can be changed through the fourth fixed pulley 71. Similarly, the third fixed pulley 70 can change the direction of the cable 42 so as to cause the cable 42 to enter into the steering member 33. Thus, the cable 42 can be kept in a tension state so as to facilitate operation.

Further referring to FIGS. 3A, 3B 4, 6A and 6B, although the steering member 33 rotates an angle along with the tray member 32, the change of the position of the first and second fixed pulleys 330, 331 does not affect the direction and position of the cable 42 between the first fixed pulley 330 and the connecting portion 412 of the pressure regulating member 41. That is, the cable 42 between the first fixed pulley 330 and the connecting portion 412 still coincides with the pivot axis L1. Therefore, although the tray member 32 rotates an angle, the decompression operation can be performed.

Figure 8:
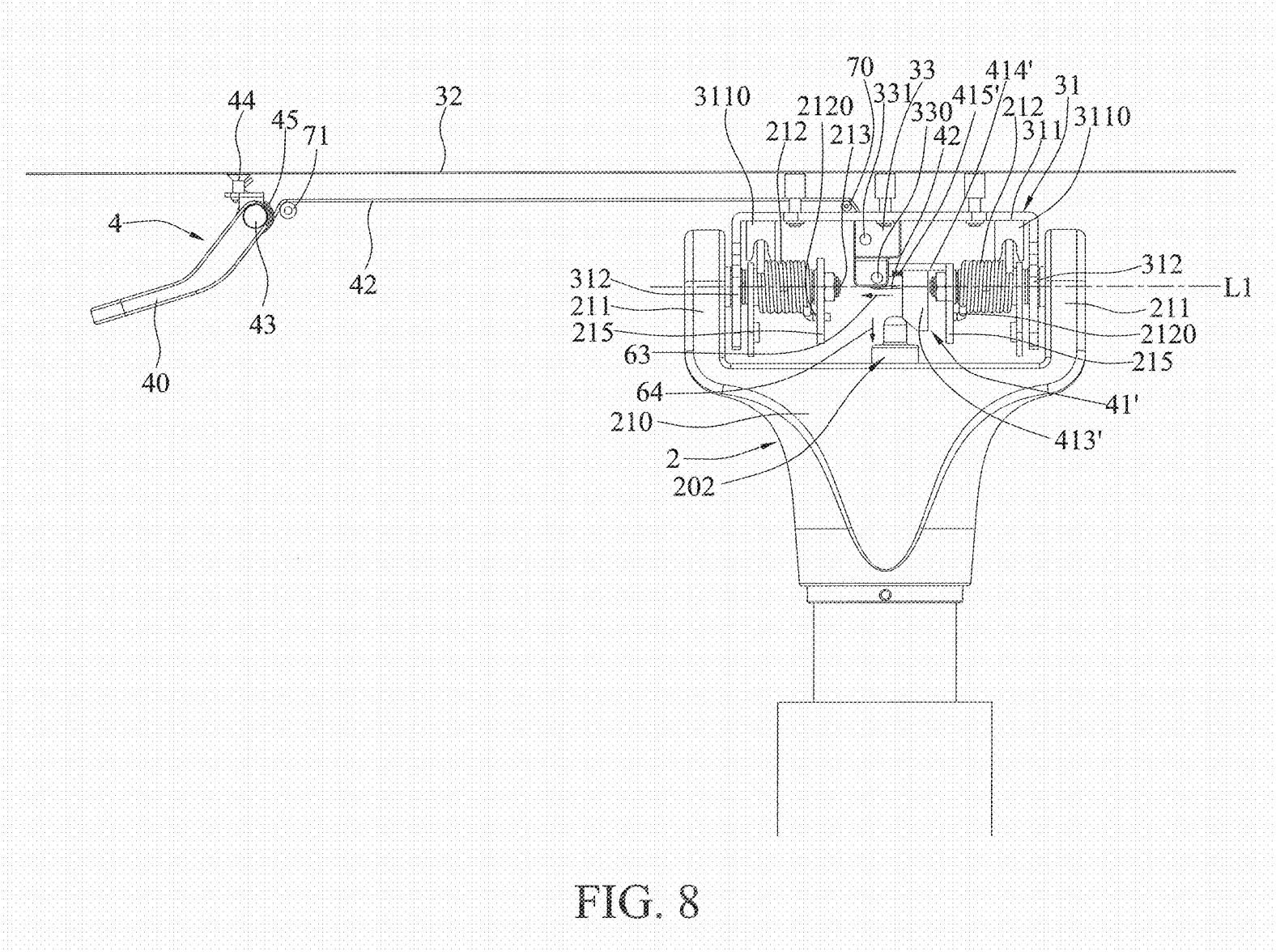
FIG. 8 is a schematic view of a pressure regulating member of the lifting and rotating device according to another embodiment of the present invention.

FIG. 8 shows another embodiment of the pressure regulating member of the lifting and rotating device. Referring to FIG. 8, the pressure regulating member 41' has a sliding block 413', a sliding track 414' connected to the connection port 215 and extending in a direction parallel to the pivot axis L1, and a spring 415'. When the cable 42 is pulled, the sliding block 63 slides along the sliding track 414' in the traction direction 63 such that one side of the sliding block 63 abuts against and presses down the control pin 202 in the direction 64. At the same time, the spring 415' is compressed to generate a restoring force that will cause the sliding block 413' to move back to the original position, i.e., the release position.

According to the present invention, since the cable between the steering member and the pressure regulating member coincides with the pivot axis of the hinges, even if the tray member connected to the rotating unit rotates an angle relative to the support member, the work plate can be raised or lowered. Therefore, the tilting mechanism and the lifting mechanism are combined to reduce the overall size of the device and simplify the structure of the device. Furthermore, the lifting and tilting mechanisms do not affect one another, so as to facilitate the practical operation. In the present invention, no matter whether the office furniture is folded, at a horizontal position or tilted to a certain angle, a lifting operation can be performed.

The above-described descriptions of the detailed embodiments are only to illustrate the preferred implementation according to the present invention, and it is not intended to limit the scope of the present invention. Accordingly, all modifications and variations completed by those with ordinary skill in the art should fall within the scope of present invention defined by the appended claims.

What is claimed is:

1. A lifting and rotating device, applicable to office furniture with a base, comprising:

a lifting unit, comprising:

a gas lift configured to be disposed on the base of the office furniture and having a telescopic rod and a control pin disposed at one end of the telescopic rod for controlling movement of the telescopic rod; and a support member disposed on the end of the telescopic rod adjacent to the control pin and capable of moving up and down along with the movement of the telescopic rod, wherein the support member has at least a hinge for defining a pivot axis;

a rotating unit comprising a main body pivotally disposed on the hinge and rotatable around the pivot axis; and a decompression unit, comprising:

a handle movable between a release position and a control position;

a pressure regulating member pivotally disposed on the hinge and normally located at a release position; and a cable having one end connected to the handle and the other end connected to the pressure regulating member at a position that is substantially located on the pivot axis;

wherein the handle is normally located at the release position, and when the rotating unit rotates around the pivot axis, the relative position between the pressure regulating member and the control pin remains unchanged; on the other hand, when the handle is moved to the control position by an external force, the pressure regulating member is moved to press the control pin.

2. The device of claim 1, wherein the rotating unit further comprises a steering member disposed on a surface of the main body close to the pressure regulating member and away from the support member so as to change the traction direction of the cable.

3. The device of claim 2, wherein the rotating unit further comprises a tray member fixed to one side of the main body away from the hinge and the office furniture further comprises a work plate disposed on the tray member.

4. The device of claim 3, wherein the handle is disposed on a fixed shaft that is fixed to the tray member through a fixing portion and has a first torsion spring disposed therearound, such that the handle is moved around the fixed shaft so as to pull the cable extending along the pivot axis, thereby causing the pressure regulating member to move, wherein when the handle is at the control position, the first torsion spring is compressed to generate a restoring force to move the handle back to the release position.

5. The device of claim 3, wherein the main body of the rotating unit comprises a first plate connected to the tray member and two second plates vertically disposed at two ends of the first plate such that the first and second plates form an inverted U-shaped structure, wherein the hinge passes through the second plates so as to cause the rotating unit to rotate around the pivot axis and move between a first position and a second position.

6. The device of claim 5, wherein the hinge has a second torsion spring having a first end fixed to a connection port of the support member and a second end abutting against an abutting portion of the first plate.

7. The device of claim 6, wherein the pressure regulating member is disposed on the connection port and comprises a connecting portion for connecting with the cable and an abutting portion for abutting against the gas lift.

8. The device of claim 6, wherein the pressure regulating member comprises a sliding block, a sliding track and a spring, wherein when the cable is pulled, the sliding block slides along the sliding track connected to the connection port and returns to the release position through the spring.

9. The device of claim 5, wherein the steering member is a pulley group that comprises a first fixed pulley and a second fixed pulley, and wherein the traction direction of the cable is changed through the first and second fixed pulleys and the rotating unit is located at the first position or the second position, and the cable is connected to the pressure regulating member through the first fixed pulley at a position that is located on the pivot axis.

10. The device of claim 9, further comprising a third fixed pulley disposed between the tray member and the main body of the rotating unit and a fourth fixed pulley disposed close to the handle, the traction direction of the cable being changed through the third and fourth fixed pulleys.

11. The device of claim 2, wherein the control pin comprises a gas pressure head disposed on the end of the telescopic rod close to the support member and a valve control member, wherein when the pressure regulating member is at the release position, the pressure regulating member abuts against the gas pressure head without pressing down the gas pressure head, and when the pressure regulating member is pulled by the cable, the pressure regulating member presses down the gas pressure head to cause the valve control member to regulate the internal pressure of the gas lift.

12. The device of claim 11, wherein the gas lift further comprises an abutting member disposed around the gas pressure head for abutting against the pressure regulating member.

13. The device of claim 2, further comprising a locking unit, which comprises:

an outer positioning portion disposed on the hinge;

a locking rod having a screwing structure and passing through the support member, the rotating unit and the outer positioning portion, one end of the locking rod having a washer attached to the outer positioning portion and the other end being exposed from the support member; and a locking member disposed around the other end of the locking rod exposed from the support member, wherein by moving the locking rod to lock the screwing structure and the washer, the distance between the locking member and the washer is adjusted.

14. The device of claim 13, wherein the locking unit further comprises two iron plates disposed between the support member and the rotating unit and between the rotating unit and the outer positioning portion, respectively, so as to increase the friction effect.

* * * * *